US010968908B2

(12) United States Patent
Sato et al.

(10) Patent No.: US 10,968,908 B2
(45) Date of Patent: Apr. 6, 2021

(54) SCROLL FLUID MACHINE, AND METHOD FOR PROCESSING SCROLL MEMBER

(71) Applicant: MITSUBISHI HEAVY INDUSTRIES THERMAL SYSTEMS, LTD., Tokyo (JP)

(72) Inventors: Hajime Sato, Tokyo (JP); Yoshiyuki Kimata, Tokyo (JP); Masashi Hamano, Tokyo (JP); Takahide Ito, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 258 days.

(21) Appl. No.: 16/090,951

(22) PCT Filed: Aug. 23, 2017

(86) PCT No.: PCT/JP2017/030210
§ 371 (c)(1),
(2) Date: Oct. 3, 2018

(87) PCT Pub. No.: WO2018/038183
PCT Pub. Date: Mar. 1, 2018

(65) Prior Publication Data

US 2019/0113033 A1 Apr. 18, 2019

(30) Foreign Application Priority Data

Aug. 26, 2016 (JP) ..... JP2016-165701

(51) Int. Cl.
*F04C 18/02* (2006.01)
*F04C 27/00* (2006.01)

(52) U.S. Cl.
CPC ..... *F04C 18/0215* (2013.01); *F04C 18/0276* (2013.01); *F04C 18/0284* (2013.01); *F04C 27/005* (2013.01); *F04C 2230/10* (2013.01)

(58) Field of Classification Search
CPC ..... F04C 18/0215; F04C 18/0276; F04C 18/0284; F04C 27/005; F04C 18/0246; F04C 18/0269
See application file for complete search history.

(56) References Cited

U.S. PATENT DOCUMENTS 4,548,555 A * 10/1985 Hiraga ..... F01C 1/0246 418/55.2
5,496,161 A * 3/1996 Machida ..... F04C 18/0276 418/55.2

(Continued)

FOREIGN PATENT DOCUMENTS

EP 2894338 A1 7/2015
EP 2894339 A1 7/2015

(Continued)

OTHER PUBLICATIONS

Extended European Search Report dated Apr. 30, 2019, for corresponding European Patent Application No. 17843661.4.

(Continued)

*Primary Examiner* — Deming Wan
(74) *Attorney, Agent, or Firm* — Birch, Stewart, Kolasch & Birch, LLP

(57) ABSTRACT

Provided is a scroll fluid machine which is capable of inhibiting contact between tooth tip corners and tooth bottom corners. The present invention is provided with: a wall inclined portion (**3*b*1) of which a facing surface has a distance to an end plate which continuously decreases from the outer circumferential side to the inner circumferential side; and an end plate inclined portion (5*a*1). Chamfered portions (8*a*) are provided to tooth tip corners (8**) of a tooth (Continued)

tip of a wall (3*b*) which face tooth bottom corners (9) of bases of mating walls (5*b*). The chamfered portions (8*a*) have a shape which avoids contact with step parts (9*a*) which are formed at the tooth bottom, and which are adjacent to the tooth bottom corners (9).

7 Claims, 10 Drawing Sheets

(56) References Cited

U.S. PATENT DOCUMENTS

| | | | | |
|---|---|---|---|---|
| 2011/0200475 | A1* | 8/2011 | Hirata | F04C 18/0215 418/55.1 |
| 2014/0308146 | A1 | 10/2014 | Hirata et al. | |
| 2017/0342837 | A1 | 11/2017 | Takeuchi et al. | |

FOREIGN PATENT DOCUMENTS

| | | | |
|---|---|---|---|
| JP | 61-76185 | U | 5/1986 |
| JP | 1227886 | A | 9/1989 |
| JP | 5-106569 | A | 4/1993 |
| JP | 5-187371 | A | 7/1993 |
| JP | 11-190287 | A | 7/1999 |
| JP | 2002-70766 | A | 3/2002 |
| JP | 2005-16335 | A | 1/2005 |
| JP | 2009-228476 | A | 10/2009 |
| JP | 2010-196663 | A | 9/2010 |
| JP | 2014-1692 | A | 1/2014 |
| JP | 2014-80940 | A | 5/2014 |
| JP | 2015-55173 | A | 3/2015 |
| JP | 2015-98794 | A | 5/2015 |
| JP | 2016-113957 | A | 6/2016 |

OTHER PUBLICATIONS

Korean Office Action for Korean Application No. 10-2018-7029368, dated Nov. 21, 2019, with an English translation.
International Search Report, dated Oct. 10, 2017, for International Application No. PCT/JP2017/030210, with an English translation.
Japanese Office Action, dated Dec. 19, 2017, for Japanese Application No. 2016-165701, with an English translation.
Written Opinion of the International Searching Authority, dated Oct. 10, 2017, for International Application No. PCT/JP2017/030210, with an English translation.

* cited by examiner

SCROLL FLUID MACHINE, AND METHOD FOR PROCESSING SCROLL MEMBER

TECHNICAL FIELD

The present invention relates to a scroll fluid machine and a method for processing a scroll member.

BACKGROUND ART

In general, a scroll fluid machine is known, in which a fixed scroll member and an orbiting scroll member each having a spiral wall provided on an end plate mesh with each other so as to perform a revolution orbiting movement and a fluid is compressed or expanded.

As the scroll fluid machine, a so-called stepped scroll compressor which is described in PTL 1 is known. In the stepped scroll compressor, step portions are provided at positions of tooth tip surfaces and tooth bottom surfaces of spiral walls of a fixed scroll and an orbiting scroll in a spiral direction and a height on an outer peripheral side of each wall is higher than a height on an inner peripheral side thereof with each step portion as a boundary. The stepped scroll compressor is compressed (three-dimensionally compressed) not only in a circumferential direction of the wall but also in a height direction thereof, and thus, compared to a general scroll compressor (two-dimensional compression) which does not have the step portion, an amount of displacement increases, and thus, compressor capacity can increase.

CITATION LIST

Patent Literature

[PTL 1] Japanese Unexamined Patent Application Publication No. 2015-55173

SUMMARY OF INVENTION

Technical Problem

However, in the stepped scroll compressor, there is a problem that fluid leakage in the step portion is large. In addition, there is a problem that stress concentrates on a base portion of the step portion and strength decreases.

Meanwhile, the inventors are studying to provide a continuously inclined portion instead of the step portion provided on the wall and the end plate.

However, processing of the inclined portion has a problem that difficulty is higher than that when a flat surface is processed. If processing accuracy of a tooth bottom corner of a base of the wall decreases, the tooth bottom corner comes into contact with a tooth tip corner of the wall facing the tooth bottom corner, and there is a concern that performance of the scroll fluid machine decreases.

In addition, for example, when a peripheral wall portion of the wall is processed by an end mill, a tooth bottom adjacent to the tooth bottom corner is also simultaneously processed. However, it is preferable to accurately process the tooth bottom which is a continuously inclined portion.

The present invention is made in consideration of the above-described circumstances, and an object thereof is to provide a scroll fluid machine and a method for processing a scroll member capable of preventing a contact between the tooth tip corner and the tooth bottom corner.

In addition, another object of the present invention is to provide a method for processing a scroll member capable of accurately processing the tooth bottom which is the continuously inclined portion.

Solution to Problem

In order to achieve the above-described objects, and a scroll fluid machine and a method for processing a scroll member of the present invention adopt the following means.

According to an aspect of the present invention, there is provided a scroll fluid machine including: a first scroll member in which a spiral first wall is provided on a first end plate; a second scroll member in which a spiral second wall is provided on a second end plate disposed to face the first end plate and the second wall meshes with the first wall such that the second scroll member performs a revolution orbiting movement relative to the first scroll member; and an inclined portion in which an inter-facing surface distance between the first end plate and the second end plate facing each other continuously decreases from outer peripheral sides of the first wall and the second wall toward inner peripheral sides thereof, in which in a tooth tip of the wall, a chamfered portion is provided at a tooth tip corner facing a tooth bottom corner of a base of a meshing wall.

The inclined portion is provided in which the inter-facing surface distance between the first end plate and the second end plate continuously decreases from outer peripheral side of the wall toward inner peripheral side thereof. Accordingly, as a fluid sucked from the outer peripheral side flows toward the inner peripheral side, the fluid not only is compressed by a decrease of a compression chamber according to a spiral shape of the wall but also is further compressed by a decrease of the inter-facing surface distance between the end plates.

Processing of the inclined portion has difficulty higher than that of processing of a flat surface, and thus, there is a concern that processing accuracy at the tooth bottom corner of the base of the wall decreases. If the processing accuracy at the tooth bottom corner decreases, there is a concern that the tooth tip corner facing the tooth bottom corner comes into contact with the tooth bottom corner and disadvantages are generated. Accordingly, the chamfered portion is provided at the tooth tip corner, and thus, the tooth tip corner is prevented from coming into contact with the tooth bottom corner. Accordingly, it is possible to suppress a decrease in performance of the scroll fluid machine.

In addition, in the scroll fluid machine of the present invention, the chamfered portion has a shape which avoids a contact with a step portion formed at the tooth bottom corner.

There is a limit in accuracy for the processing pitch when a tool is moved with respect to a workpiece, and thus, it is difficult to smoothly process the inclined portion. Accordingly, unless the processing of the tooth bottom and the processing of the peripheral wall surfaces of the walls provided on both sides of the tooth bottom are performed through one pass at a time, there is a concern that the step portion (height deviation) is generated at the tooth bottom corner.

For example, if the one peripheral wall surface of the wall and the tooth bottom adjacent to the one peripheral wall surface are processed and thereafter, the facing other peripheral wall surface in a state where the common tooth bottom is interposed therebetween and the tooth bottom adjacent to the other peripheral wall surface are processed, the processing step having at least two passes is performed. In this case, it is difficult to accurately match heights of the tooth bottoms between the two passes, and thus, the height of the tooth bottom is deviated, and the step portion occurs at the tooth bottom corner.

In addition, in a case where the one peripheral wall surface of the wall and the tooth bottom adjacent to the one peripheral wall surface are processed at a predetermined first processing pitch, the other peripheral wall surface of the wall and the tooth bottom adjacent to the other peripheral wall surface are processed at the same first processing pitch, and thereafter, only the tooth bottom is processed at a second processing pitch which is finer than the first processing pitch, the step portion corresponding to the first processing pitch coarser than the second processing pitch is generated on the tooth bottom adjacent to the tooth bottom corner.

As described above, if the step portion exists at the tooth bottom corner, there is a concern that the tooth tip corner comes into contact with the step portion and disadvantages are generated. Accordingly, the chamfered portion having the shape which avoids the contact with the step portion is provided at the tooth tip corner, and thus, the tooth tip corner is prevented from coming into contact with the step portion. Therefore, it is possible to suppress a decrease in efficiency of the scroll fluid machine.

In addition, the scroll fluid machine of the present invention further includes a wall flat portion which is provided on outermost peripheral portions and/or innermost peripheral portions of the first wall and the second wall and has a height which is not changed, an end plate flat portion which is provided on the first end plate and the second end plate and corresponds to the wall flat portion, in which the chamfered portion is provided at the tooth tip corner of the wall corresponding to the inclined portion, and the chamfered portion is not provided at the tooth tip corner of the wall flat portion.

It is difficult to process the inclined portion, and thus, as described above, the chamfered portion is provided at the tooth tip corner so as to avoid the contact with the tooth bottom corner.

Meanwhile, unlike the inclined portion, it is not difficult to process the flat portion, and thus, it is possible to secure the processing accuracy at the tooth bottom corner. Accordingly, the chamfered portion is not provided at the tooth tip corner of the wall flat portions. Therefore, the tooth tip corner of the wall flat portion has a shape obtained after processing the peripheral wall surface and the tooth tip surface of the wall and is a shape to which the chamfering is not applied. Accordingly, in the flat portion, the clearance between the tooth tip corner and the tooth bottom corner decreases, and leakage of the fluid can be made as small as possible.

In addition, according to another aspect of the present invention, a method for processing a scroll member including an end plate, a spiral wall provided on the end plate, and an inclined portion having a height which is continuously changed in a spiral direction from a tooth bottom of the wall to a tooth tip thereof, the method including: a first peripheral wall surface processing step of processing one peripheral wall surface of the wall and a tooth bottom adjacent the one peripheral wall surface; a second peripheral wall surface processing step of processing the other peripheral wall surface of the wall and a tooth bottom adjacent to the other peripheral wall surface; and a tooth bottom processing step of processing only a tooth bottom between the one peripheral wall surface and the other peripheral wall surface.

The difficulty in the processing of the inclined portion is higher than that in the processing of the flat portion. Accordingly, the step of processing each of the peripheral wall surfaces and the step of processing only the tooth bottom are separately performed, and thus, the peripheral wall surfaces and the tooth bottom are processed through three passes. Accordingly, it is possible to accurately process the tooth bottom which becomes the inclined portion.

In addition, preferably, the processing pitch of the tooth bottom processing step is finer than the processing pitch of the processing step of each peripheral wall surface so as to further accurately process the inclined portion of the tooth bottom.

In addition, preferably, the tooth tip of the inclined portion is processed at the processing pitch which is the same as that of the tooth bottom processing step.

Moreover, the method for processing a scroll member of the present invention further includes a chamfering processing step of forming a chamfered portion at a tooth tip corner of the wall.

The chamfered portion is processed at the tooth tip corner, and thus, it is possible to form the tooth tip which does not come into contact with the facing tooth bottom corner.

Advantageous Effects of Invention

The chamfered portion is provided at the tooth tip corner, and thus, the contact between the tooth tip corner and the tooth bottom corner is prevented, and thus, it is possible to suppress a decrease in performance of the scroll fluid machine.

Only the tooth bottom is processed in the step different from the step for processing the peripheral wall portion of the wall, and thus, it is possible to accurately process the tooth bottom which is a continuously inclined portion.

BRIEF DESCRIPTION OF DRAWINGS

FIG. 1A is a longitudinal section view, and FIG. 1B is a plan view when the fixed scroll is viewed from a wall side.

FIG. 7A is a side view showing a state where the tip seal clearance relatively decreases, and FIG. 7B is a side view showing a state where the tip seal clearance relatively increases.

FIG. 10A is a longitudinal section view showing a combination with a scroll which does not have a step portion, and FIG. 10B is a longitudinal section view showing a combination with a stepped scroll.

DESCRIPTION OF EMBODIMENTS

Hereinafter, an embodiment according to the present invention will be described with reference to the drawings.

Figure 1A:
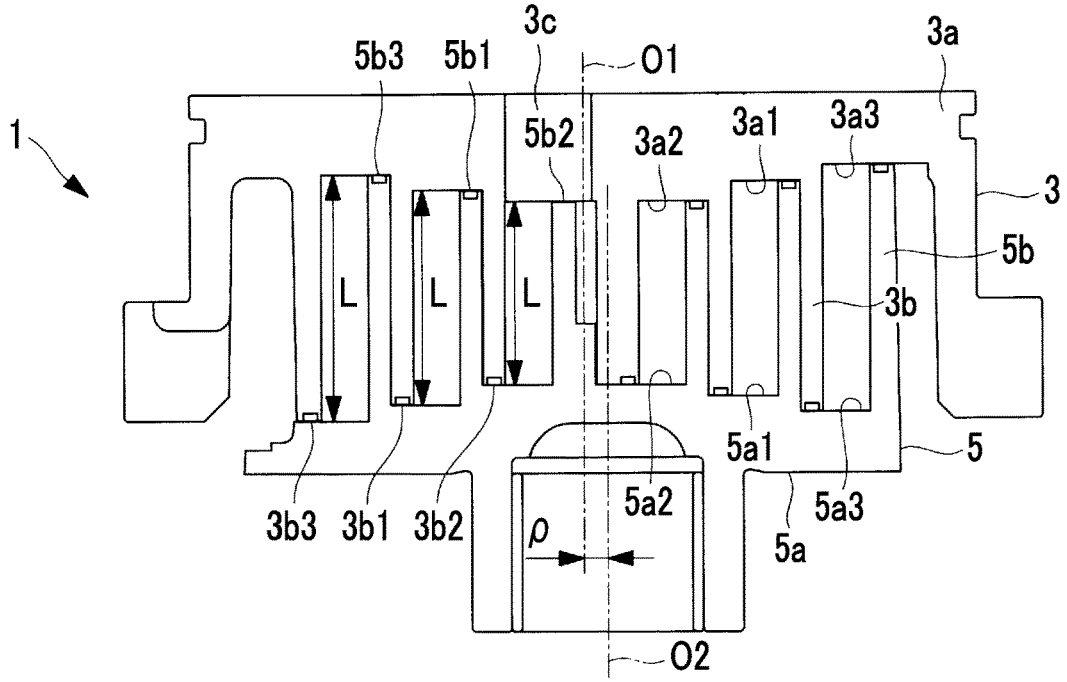
FIGS. 1A and 1B show a fixed scroll and an orbiting scroll of a scroll compressor according to an embodiment of the present invention.
Figure 1B:
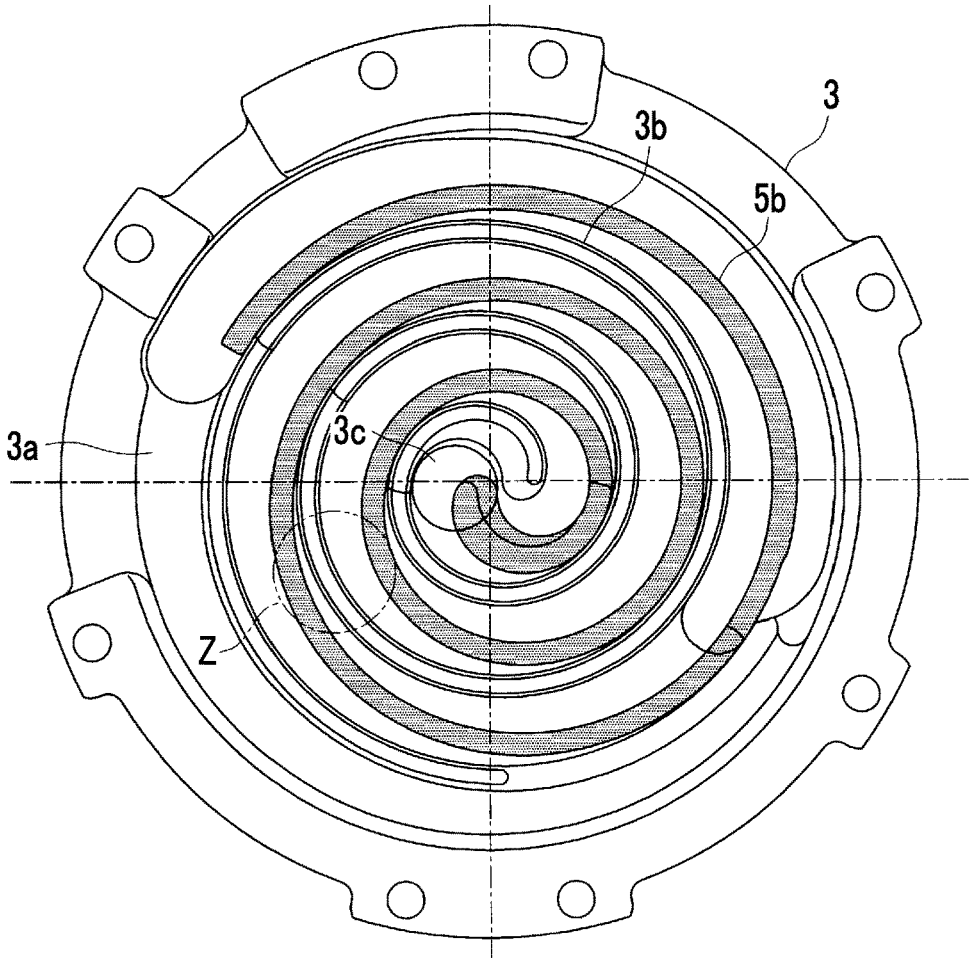

In FIGS. 1A and 1B, a fixed scroll (first scroll member) 3 and an orbiting scroll (second scroll member) 5 of a scroll compressor (scroll fluid machine) 1 are shown. For example, the scroll compressor 1 is used as a compressor which compresses a gas refrigerant (fluid) which performs a refrigerating cycle of an air conditioner or the like.

Each of the fixed scroll 3 and the orbiting scroll 5 is a metal compression mechanism which is formed of an aluminum alloy or steel, and is accommodated in a housing (not shown). The fixed scroll 3 and the orbiting scroll 5 suck a fluid, which is introduced into the housing, from an outer peripheral side, and discharge the compressed fluid from a discharge port 3*c* positioned at a center of the fixed scroll 3 to the outside.

The fixed scroll 3 is fixed to the housing, and as shown in FIG. 1A, includes an approximately disk-shaped end plate (first end plate) 3*a*, and a spiral wall (first wall) 3*b* which is erected on one side surface of the end plate 3*a*. The orbiting scroll 5 includes an approximately disk-shaped end plate (second end plate) 5*a* and a spiral wall (second wall) 5*b* which is erected on one side surface of the end plate 5*a*. For example, a spiral shape of each of the walls 3*b* and 5*b* is defined by using an involute curve or an Archimedes curve.

The fixed scroll 3 and the orbiting scroll 5 are assembled to each other such that centers thereof are separated from each other by an orbiting radius p, the walls 3*b* and 5*b* mesh with each other with phases deviated from each other by 180°, and a slight clearance (tip clearance) in a height direction is provided between tooth tips and tooth bottoms of the walls 3*b* and 5*b* of both scrolls. Accordingly, a plurality pairs of compression chambers which are formed to be surrounded by the end plates 3*a* and 5*a* and the walls 3*b* and 5*b* are symmetrically formed about a scroll center between both scrolls 3 and 5. The orbiting scroll 5 performs a revolution orbiting movement around the fixed scroll 3 by a rotation prevention mechanism such as an Oldham ring (not shown).

As shown in FIG. 1A, an inclined portion is provided, in which an inter-facing surface distance L between both end plates 3*a* and 5*a* facing each other continuously decrease from an outer peripheral side of each of the spiral walls 3*b* and 5*b* toward an inner peripheral side thereof.

Figure 2:
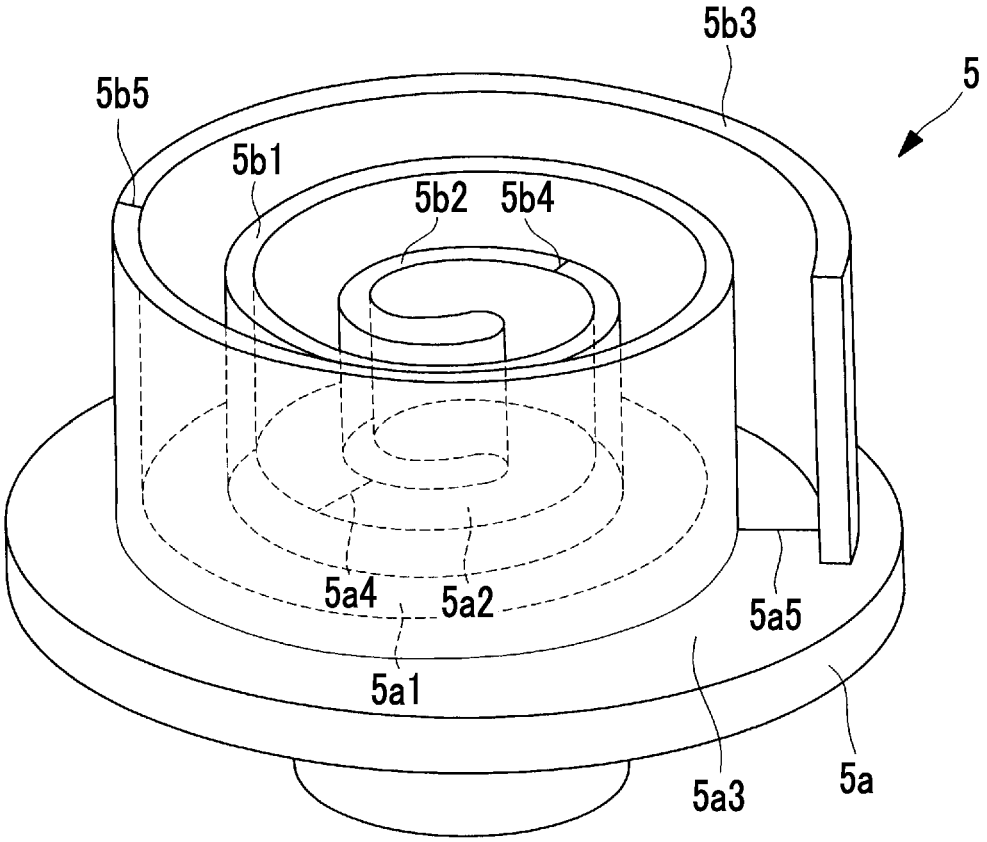
FIG. 2 is a perspective view showing the orbiting scroll of FIGS. 1A and 1B.

As shown in FIG. 2, in the wall 5*b* of the orbiting scroll 5, a wall inclined portion 5*b*1 whose height continuously decreases from an outer peripheral side toward an inner peripheral side is provided. In a tooth bottom surface of the fixed scroll 3 facing a tooth tip of the wall inclined portion 5*b*1, an end plate inclined portion 3*a*1 (refer to FIG. 1A) which is inclined according to an inclination of the wall inclined portion 5*b*1 is provided. A continuously inclined portion is formed by the wall inclined portion 5*b*1 and the end plate inclined portion 3*a*1. Similarly, a wall inclined portion 3*b*1 whose height is continuously inclined from the outer peripheral side toward the inner peripheral side is provided on the wall 3*b* of the fixed scroll 3, and an end plate inclined portion 5*a*1 facing a tooth tip of the wall inclined portion 3*b*1 is provided on the end plate 5*a* of the orbiting scroll 5.

In addition, the meaning of the continuity in the inclined portion in the present embodiment is not limited to a smoothly connected inclination but also includes an inclined portion in which small step portions inevitably generated during processing are connected to each other in a stepwise fashion and the inclined portion is continuously inclined as a whole. However, the inclined portion does not include a large step portion such as a so-called stepped scroll.

Coating is applied to the wall inclined portions 3*b*1 and 5*b*1 and/or the end plate inclined portions 3*a*1 and 5*a*1. For example, the coating includes manganese phosphate processing, nickel phosphorus plating, or the like.

As shown in FIG. 2, wall flat portions 5*b*2 and 5*b*3 each having a constant height are respectively provided on the innermost peripheral side and the outermost peripheral side of the wall 5*b* of the orbiting scroll 5. Each of the wall flat portions 5*b*2 and 5*b*3 is provided over a region of 180° around a center O2 (refer to FIG. 1A) of the orbiting scroll 5. Wall inclined connection portions 5*b*4 and 5*b*5 which become curved portions are respectively provided at positions at which the wall flat portions 5*b*2 and 5*b*3 and the wall inclined portion 5*b*1 are connected to each other.

Similarly, in the tooth bottom of the end plate 5*a* of the orbiting scroll 5, end plate flat portions 5*a*2 and 5*a*3 each having a constant height are provided. Each of the end plate flat portions 5*a*2 and 5*a*3 is provided over a region of 180° around the center of the orbiting scroll 5. End plate inclined connection portions 5*a*4 and 5*a*5 which become curved portions are respectively provided at positions at which the end plate flat portions 5*a*2 and 5*a*3 and the end plate inclined portion 5*a*1 are connected to each other.

Figure 3:
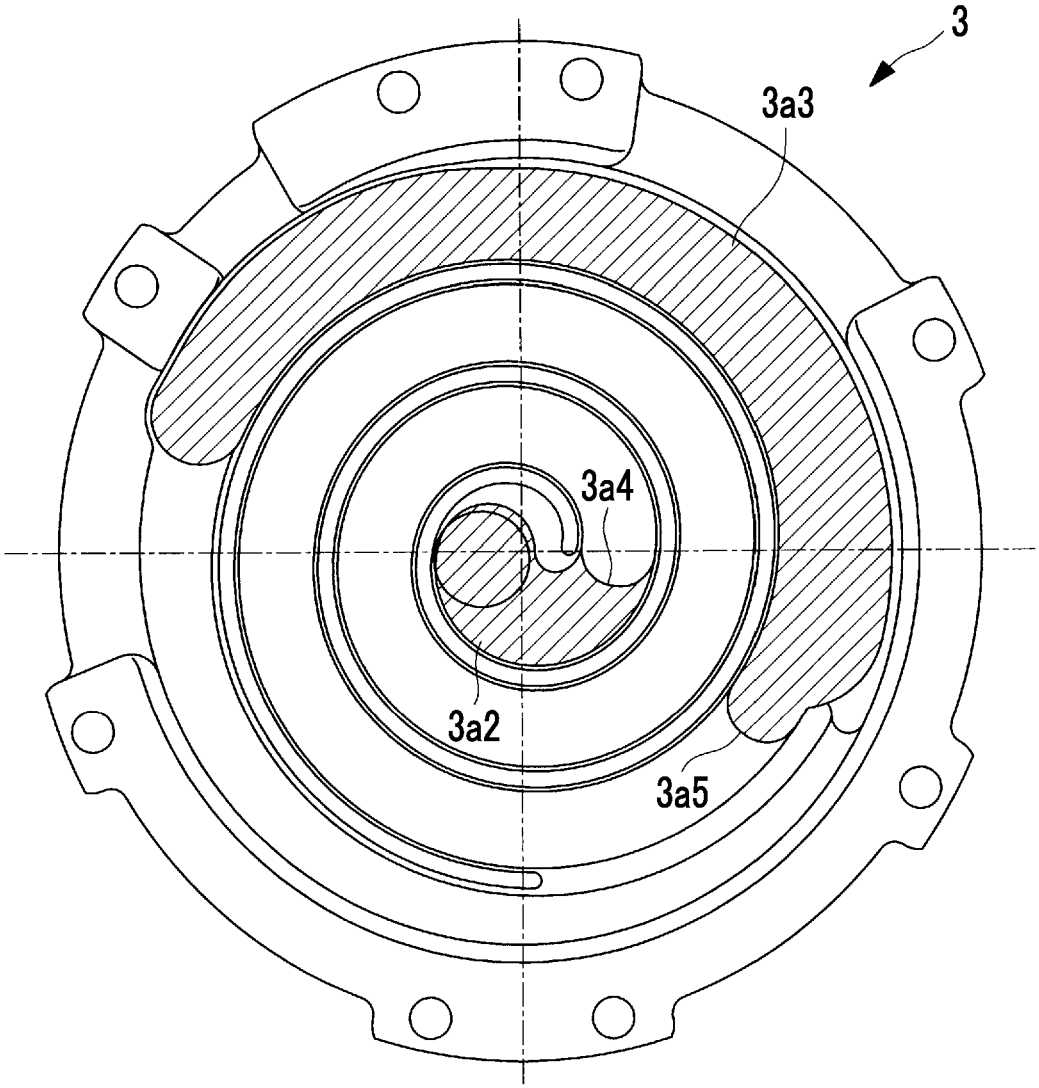
FIG. 3 is a plan view showing an end plate flat portion provided in the fixed scroll.
Figure 4:
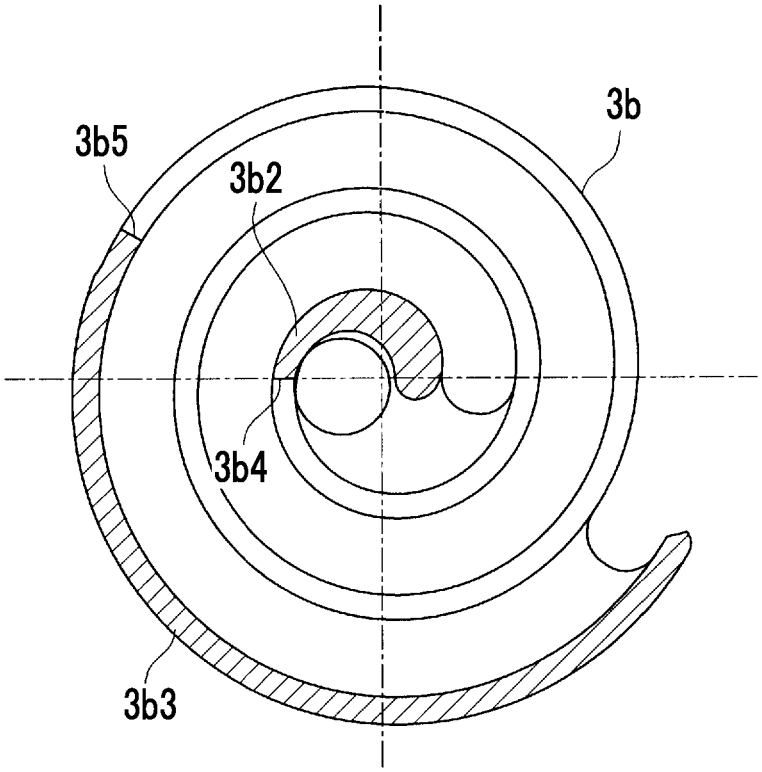
FIG. 4 is a plan view showing a wall flat portion provided in the fixed scroll.

As shown by hatching in FIGS. 3 and 4, similarly to the orbiting scroll 5, in the fixed scroll 3, end plate flat portions 3*a*2 and 3*a*3, wall flat portions 3*b*2 and 3*b*3, end plate inclined connection portions 3*a*4 and 3*a*5, and wall inclined connection portions 3*b*4 and 3*b*5 are provided.

Figure 5:
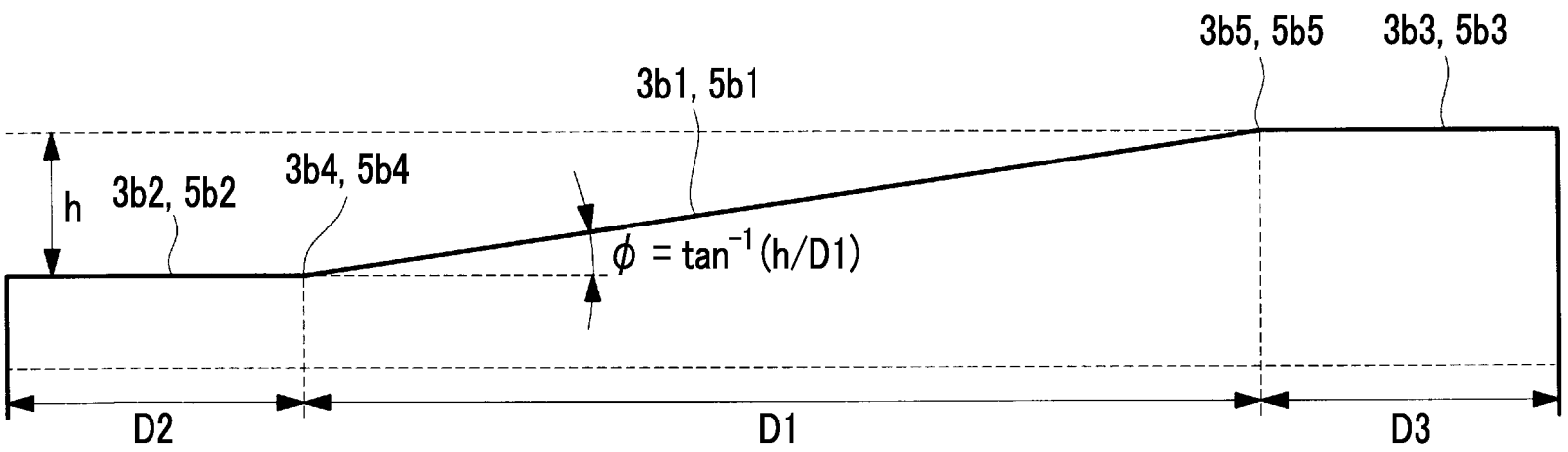
FIG. 5 is a schematic view showing a wall which is displayed to extend in a spiral direction.

FIG. 5 is a schematic view showing the walls 3*b* and 5*b* which are displayed to extend in a spiral direction. As shown in FIG. 5, the wall flat portions 3*b*2 and 5*b*2 on the innermost peripheral side are provided over a distance D2, and the wall flat portions 3*b*3 and 5*b*3 on the outermost peripheral side are provided over a distance D3. Each of the distance D2 and the distance D3 is a length corresponding to the region which becomes 180° around each of the centers O1 and O2 of the respective scrolls 3 and 5. The wall inclined portions 3*b*1 and 5*b*1 are provided over the distance D1 between the wall flat portions 3*b*2 and 5*b*2 on the innermost peripheral side and the wall flat portions 3*b*3 and 5*b*3 on the outermost peripheral side. If a height difference between each of the wall flat portions 3*b*2 and 5*b*2 on the innermost peripheral side and each of the wall flat portions 3*b*3 and 5*b*3 on the outermost peripheral side is defined as h, an inclination of each of the wall inclined portions 3*b*1 and 5*b*1 is represented by the following Expression.

$$\varphi=\tan^{-1}(h/D1) \quad (1)$$

In this way, the inclination φ of the inclined portion is constant in a circumferential direction in which each of the spiral walls 3*b* and 5*b* extends.

Figure 6:
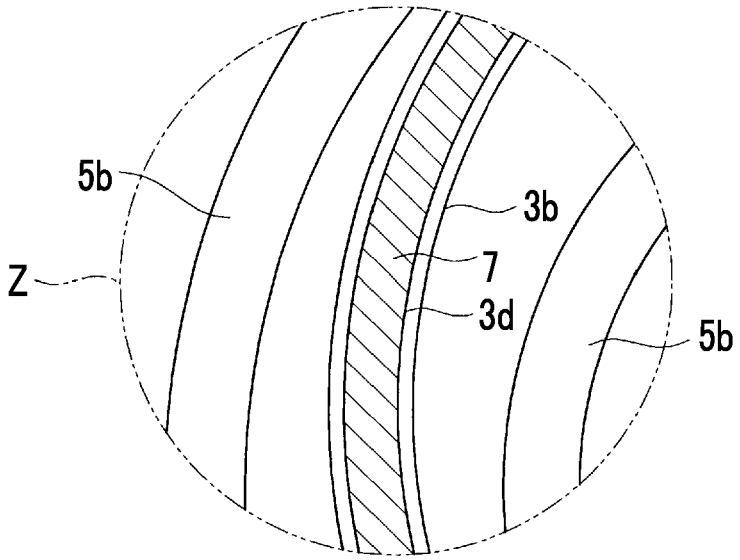
FIG. 6 is a partially enlarged view showing a region indicated by a reference numeral Z in FIG. 1B in an enlarged manner.

FIG. 6 is a partially enlarged view showing a region indicated by a reference numeral Z in FIG. 1B in an enlarged manner. As shown FIG. 6, a tip seal is provided in the tooth tip of the wall 3*b* of the fixed scroll 3. The tip seal 7 is formed of a resin and comes into contact with the tooth bottom of the end plate 5*a* of the facing orbiting scroll 5 so as to seal a fluid. The tip seal 7 is accommodated in a tip seal groove 3*d* which is formed on the tooth tip of the wall 3*b* in the circumferential direction. A compressed fluid enters the tip seal groove 3*d*, presses the tip seal 7 from a rear surface thereof to push the tip seal 7 toward the tooth bottom side, and thus, the tip seal 7 comes into contact with the facing the tooth bottom. In addition, a tip seal is also provided in the tooth tip of the wall 5*b* of the orbiting scroll 5.

Figure 7A:
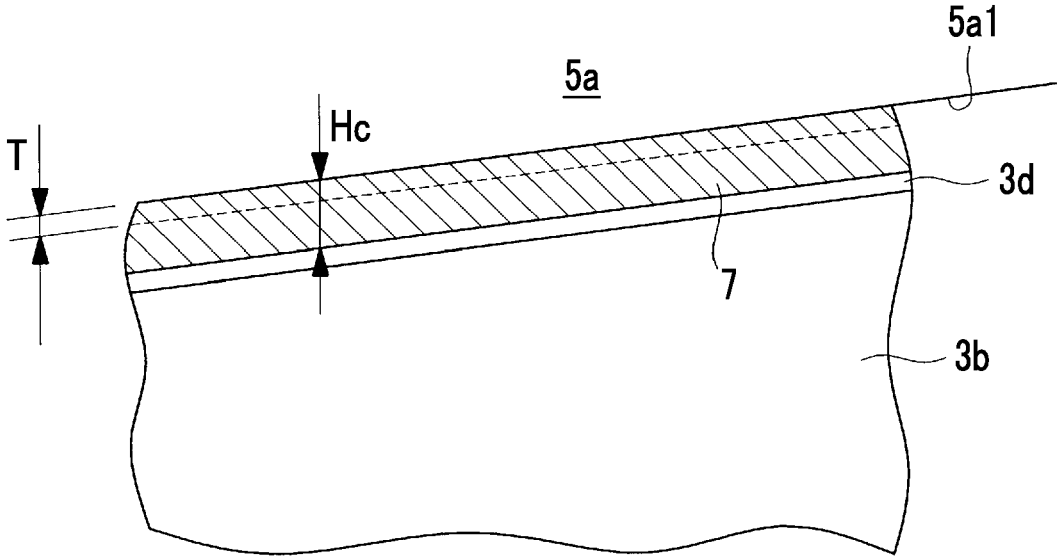
FIGS. 7A and 7B show a tip seal clearance of a portion shown in FIG. 6.
Figure 7B:
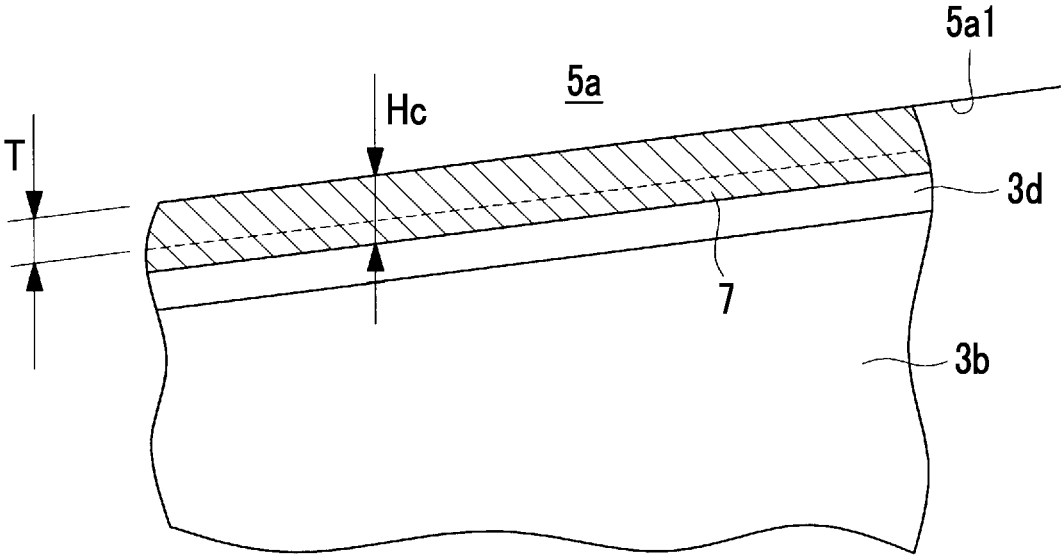

As shown in FIGS. 7A and 7B, a height Hc of the tip seal 7 in the height direction of the wall 3*b* is constant in the circumferential direction.

If both the scrolls 3 and 5 perform the revolution orbiting movement relative to each other, the positions of the tooth tip and the tooth bottom are relatively deviated by an orbiting radius (orbiting radius ρ×2). In the inclined portion, the tip clearance between the tooth tip and the tooth bottom is changed due to the positional deviation between the tooth tip and the tooth bottom. For example, in FIG. 7A, a tip clearance T decreases, and in FIG. 7B, the tip clearance T increases. Even when the tip clearance T is changed by an orbiting movement, the tip seal 7 is pressed toward the tooth bottom side of the end plate 5*a* by the compressed fluid from the rear surface, and the tip seal 7 can follow the tooth bottom so as to seal the tooth bottom.

Figure 8:
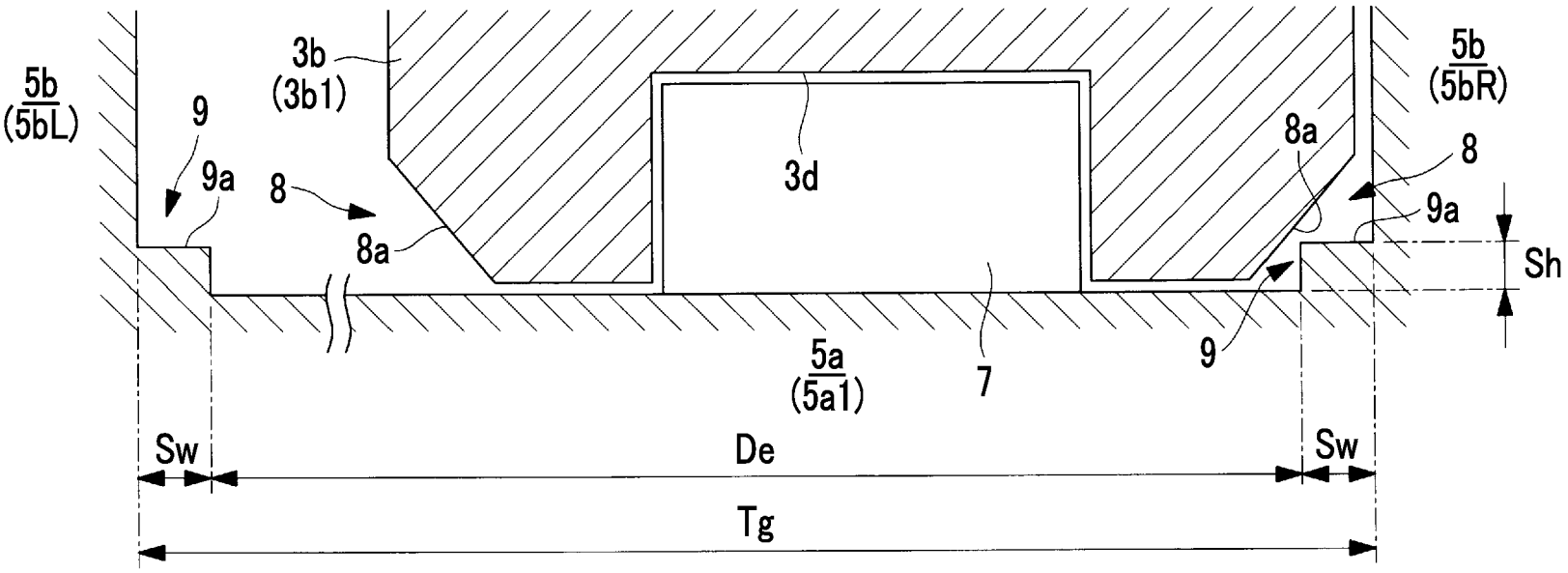
FIG. 8 is a longitudinal section view showing a cross section around a tooth tip of an inclined portion which is cut in a radial direction.

FIG. 8 is a longitudinal section view showing a cross section around the tooth tip which is cut in a radial direction at a predetermined position of the wall inclined portion 3*b*1 of the fixed scroll 3. In addition, a cross section around the tooth tip of the wall inclined portion 5*b*1 of the orbiting scroll 5 which is cut in the radial direction also has a similar shape. Accordingly, hereinafter, only a relationship between the tooth tip of the wall inclined portion 3*b*1 of the fixed scroll 3 and the tooth bottom of the end plate inclined portion 5*a*1 of the orbiting scroll 5 facing the tooth tip will be described.

As shown in FIG. 8, the tooth tip of the wall 3*b* and the tooth bottom of the end plate 5*a* are disposed so as to face each other. The tip seal 7 received in the tip seal groove 3*d* is disposed on the tooth tip of the wall 3*b*. The tip seal 7 is pressed toward the tooth bottom side (lower side in FIG. 8) by a pressure of the fluid which has entered the rear surface of the tip seal 7. The wall 3*b* is positioned around one wall 5*b*R (right side in FIG. 8) and is sealed so as to close the compression chamber at this position. The wall 3*b* is separated from the other wall 5*b*L (left side in FIG. 8) and the compression chamber is formed therebetween.

Chamfered portions 8*a* which are chamfered in a C shape are provided at both tooth tip corners 8 of the wall inclined portion 3*b*1. Each of the chamfered portions 8*a* is provided over a region corresponding to the wall inclined portion 3*b*1 continued in the spiral direction. In addition, the chamfered portion 8*a* is chamfered in an R shape and may be chamfered in any shape as long as a protruding angular shape is removed.

The chamfered portion 8*a* is not provided on the flat portions 3*b*2 and 3*b*3. That is, the tooth tip corner in each of the flat portions 3*b*2 and 3*b*3 has a shape after processing the peripheral wall surface and the tooth tip surface of the wall 3*b* and has a shape which is not subjected to chamfering processing, for example, has a corner portion set to approximately 90°.

The chamfered portion 8*a* has a shape which does not contact with a step portion 9*a* existing at a tooth bottom corner 9 adjacent to the base of the wall 5*b* of the orbiting scroll 5. For example, in the C chamfering of the chamfered portion 8*a*, C is 0.1 to 0.5.

The step portion 9*a* positioned at the tooth bottom corner 9 is inevitably formed by processing the end plate inclined portion 5*a*1. This is because processing of forming an inclined surface on the tooth bottom of the end plate 5*a* is more difficult than a case of processing a flat surface. The end plate inclined portion 5*a*1 is processed by a processing step having the following three passes.

First, in first pass processing, a peripheral wall surface of one wall 5*b*R and a tooth bottom adjacent to the peripheral wall surface are processed by an end mill (first peripheral wall surface processing). As a first processing pitch p1, a processing pitch in this step is given as a command program of a Numerical Control (NC) machine tool. In this case, a diameter of the end mill is defined as De and is a dimension which is slightly smaller than that of the tooth bottom width Tg.

Next, in processing of a second pass, a peripheral wall surface of the other wall 5*b*L and a tooth bottom adjacent to the peripheral wall surface are processed by an end mill (second peripheral wall surface processing step). A processing pitch in this step is the first processing pitch p1 which is the same as that of the first pass. The diameter of the end mill is the diameter De which is the same as that of the first pass.

Finally, in processing of a third pass, only a center tooth bottom between the peripheral wall surface of the one wall 5*b*R and the peripheral wall surface of the other wall 5*b*L is processed (tooth bottom processing step). As a processing pitch in this step, a second processing pitch p2, which is finer than the first processing pitch p1 of the first pass and the second pass, is used. Accordingly, an inclination of a tooth bottom surface is formed as smoothly as possible. The diameter of the end mill is smaller than the tooth bottom width Tg, and for example, as the diameter of the end mill, the diameter De which is the same as those of the first pass and the second pass is used.

As described above, according to the processing step having the three passes, the end plate inclined portion 5*a*1 and the peripheral wall surface of the wall 5*b* adjacent to the end plate inclined portion 5*a*1. In this case, the second processing pitch p2 used in the processing of the third pass of processing the tooth bottom is finer than the first processing pitch p1 of each of the first and second passes, the step portions 9*a* remain on the tooth bottom corners 9 on both sides on which the processing of the third pass is not performed.

If it is assumed that the processing of the third pass is performed along the center of the tooth bottom width, a width Sw of the step portion 9*a* becomes (Tg−De)/2.

A height Sh of the step portion 9*a* is a dimension due to a difference between the first processing pitch p1 and the second processing pitch p2, and for example, becomes several μmn to several tens μm. The step portion 9*a* is generated by a difference (processing error) between cutting edge heights (in a vertical direction in FIG. 8) of the end mill at the time of the processing of the first pass and the second pass and the cutting edge height of the end mill at the time of the processing of the third pass.

The processing of the wall inclined portion 3*b*1 which is the tooth tip of the wall 3*b* is performed using the second processing pitch p2 which is the same as that of the processing of the third pass.

Thereafter, removal processing is performed so as to form the chamfered portion 8*a* at each tooth tip corner 8 (chamfering processing step).

The above-described scroll compressor 1 is operated as follows.

The orbiting scroll 5 performs the revolution orbiting movement around the fixed scroll 3 by a drive source such as an electric motor (not shown). Accordingly, the fluid is sucked from the outer peripheral sides of the respective scrolls 3 and 5, and the fluid is taken into the compression chambers surrounded by the respective walls 3*b* and 5*b* and the respective end plates 3*a* and 5*a*. The fluid in the compression chambers is sequentially compressed while being moved from the outer peripheral side toward the inner peripheral side, and finally, the compressed fluid is discharged from a discharge port 3*c* formed in the fixed scroll 3. When the fluid is compressed, the fluid is compressed in the height directions of the walls 3*b* and 5*b* in the inclined portions formed by the end plate inclined portions 3*a*1 and 5*a*1 and the wall inclined portions 3*b*1 and 5*b*1, and thus, the fluid is three-dimensionally compressed.

According to the present embodiment, the following operational effects are exerted.

The processing of the inclined portion has difficulty higher than that of the processing of the flat surface, and thus, there is a concern that processing accuracy at the tooth bottom corner 9 of the base of the wall 5*b* decreases. If the processing accuracy at the tooth bottom corner 9 decreases, there is a concern that the tooth tip corner 8 of the wall 3*b* facing the tooth bottom corner 9 comes into contact with the tooth bottom corner 9. Accordingly, the chamfered portion 8*a* is provided at the tooth tip corner 8, and thus, the tooth tip corner 8 is prevented from coming into contact with the tooth bottom corner 9. Accordingly, it is possible to suppress a decrease in performance of the scroll compressor 1.

There is a limit in accuracy for the processing pitch when the end mill (tool) is moved with respect to a workpiece, and thus, it is difficult to smoothly process the inclined portion. Accordingly, unless the processing of the tooth bottom and the processing of the peripheral wall surfaces of the walls 5*b* provided on both sides of the tooth bottom are performed through one pass at a time, there is a concern that a step portion (height deviation) is generated in the tooth bottom adjacent to the tooth bottom corner 9.

In the present embodiment, the peripheral wall surface of the one wall 5*b*R and the tooth bottom portion adjacent to the peripheral wall surface are processed at the first processing pitch p1, the peripheral wall surface of the other wall 5*b*L and the tooth bottom adjacent to the peripheral wall surface are processed at the first processing pitch p1, and thereafter, only the center tooth bottom is processed at the second processing pitch p2 which is finer than the first processing pitch p1. In this case, the step portion 9*a* corresponding to the first processing pitch p1 coarser than the second processing pitch p2 is generated on the tooth bottom adjacent to the tooth bottom corner 9.

Accordingly, the chamfered portion 8*a* having the shape which avoids the contact with the step portion 9*a* is provided at the tooth tip corner 8 of the wall 3*b*, and thus, the tooth tip corner 8 is prevented from coming into contact with the step portion 9*a*.

The flat portion is not difficult to be processed unlike the inclined portion, and thus, the processing accuracy of the tooth bottom corner 9 can be secured. Accordingly, the chamfered portion 8*a* is not provided at the tooth tip corner 8 of each of the wall flat portions 3*b*2, 3*b*3, 5*b*2, and 5*b*3. That is, the tooth tip corner 8 of each of the wall flat portions 3*b*2, 3*b*3, 5*b*2, and 5*b*3 has the shape obtained after processing the peripheral wall surface and the tooth tip surface of each of the wall 3*b* and 5*b* and is a shape to which the chamfering is not applied. Accordingly, in each of the flat portions 3*b*2, 3*b*3, 5*b*2, and 5*b*3, the clearance between the tooth tip corner 8 and the tooth bottom corner 9 decreases, and leakage of the compressed fluid can be made as small as possible.

The step of processing each of the peripheral wall surfaces of the walls 5*b*R and 5*b*L and the step of processing only the tooth bottom are separately performed, and thus, the peripheral wall surfaces and the tooth bottom are processed through three passes. Accordingly, it is possible to accurately process the tooth bottom which becomes the inclined portion.

In addition, in the present embodiment, the configuration is described in which the chamfered portion 8*a* is provided at the tooth tip corner 8 so as to avoid the contact with the step portion 9*a* generated in the case where the tooth bottom is processed by the processing of the three passes. However, as shown in FIG. 9, the present invention can be applied to a step portion 9*a*' generated in a case where the tooth bottom is processed by processing of two passes.

Figure 9:
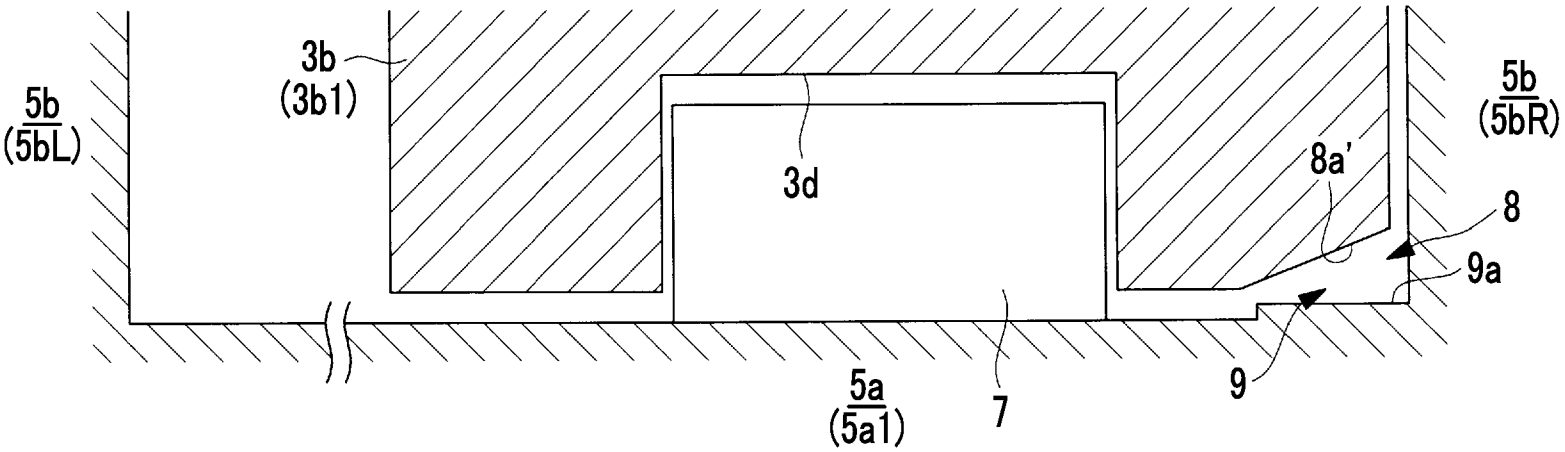
FIG. 9 is a longitudinal section view showing a modification example of FIG. 8.

A tooth bottom of the end plate 5*a* shown in FIG. 9 is processed by two passes as follows.

First, in processing of a first pass, the peripheral wall surface of one wall 5*b*R and the tooth bottom adjacent to the peripheral wall surface are processed by an end mill.

Next, in processing of a second pass, the peripheral wall surface of the other wall 5*b*L and the tooth bottom adjacent to the peripheral wall surface are processed by the end mill. In this case, the formed tooth bottom becomes a final shape. In the second pass, the processing pitch may use the second processing pitch p2 which is smaller than the first processing pitch p1 of the first pass, or may use the first processing pitch p1.

If the processing of the two passes is performed, as described above, the step portion 9*a* is inevitably generated by the difference between the processing pitches or the difference (processing error) between the cutting edge heights of the end mill at the time of the processing of the first pass and the second pass.

In order to avoid the contact with the step portion 9*a*', a chamfered portion 8*a*' is provided at the tooth tip corner 8 of the wall 3*b*. Accordingly, it is possible to avoid the contact with the step portion 9*a* generated by the processing of the two passes, and thus, it is possible to suppress the decrease in the performance of the scroll compressor 1.

In addition, in the present embodiment, the end plate inclined portions 3*a*1 and 5*a*1 and the wall inclined portions 3*b*1 and 5*b*1 are provided on both scrolls 3 and 5. However, the end plate inclined portions 3*a*1 and 5*a*1 and the wall inclined portions 3*b*1 and 5*b*1 may be provided at any one of both scrolls 3 and 5.

Figure 10A:
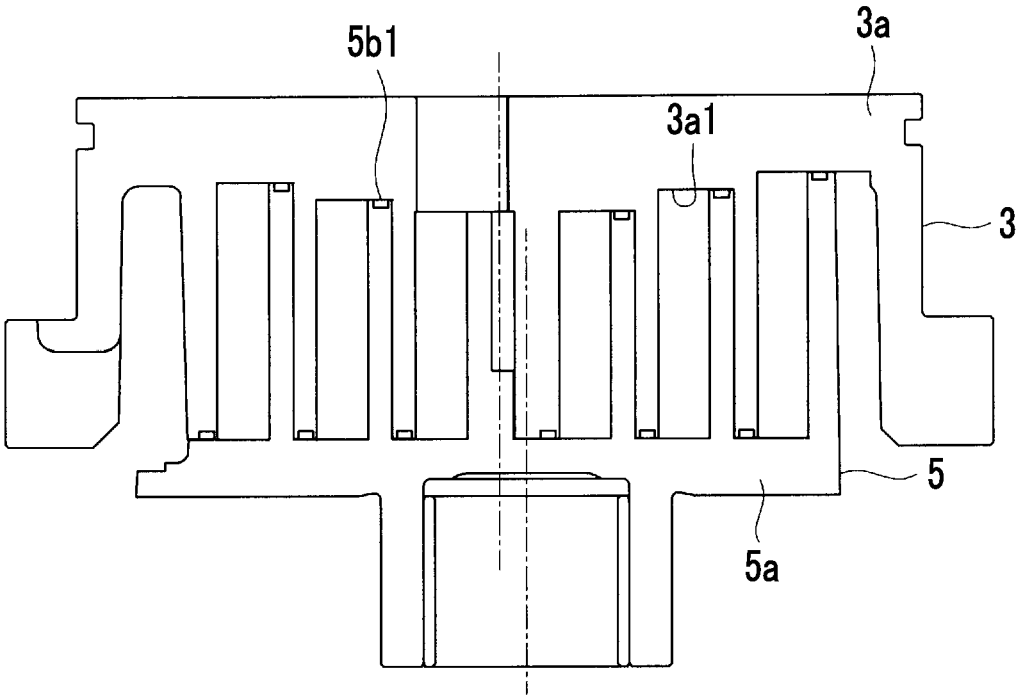
FIGS. 10A and 10B show a modification example.

Specifically, as shown in FIG. 10A, in a case where the wall inclined portion 5*b*1 is provided on the one wall (for example, orbiting scroll 5) and the end plate inclined portion 3*a*1 is provided on the other end plate 3*a*, the other wall and the one end plate 5*a* may be flat.

Figure 10B:
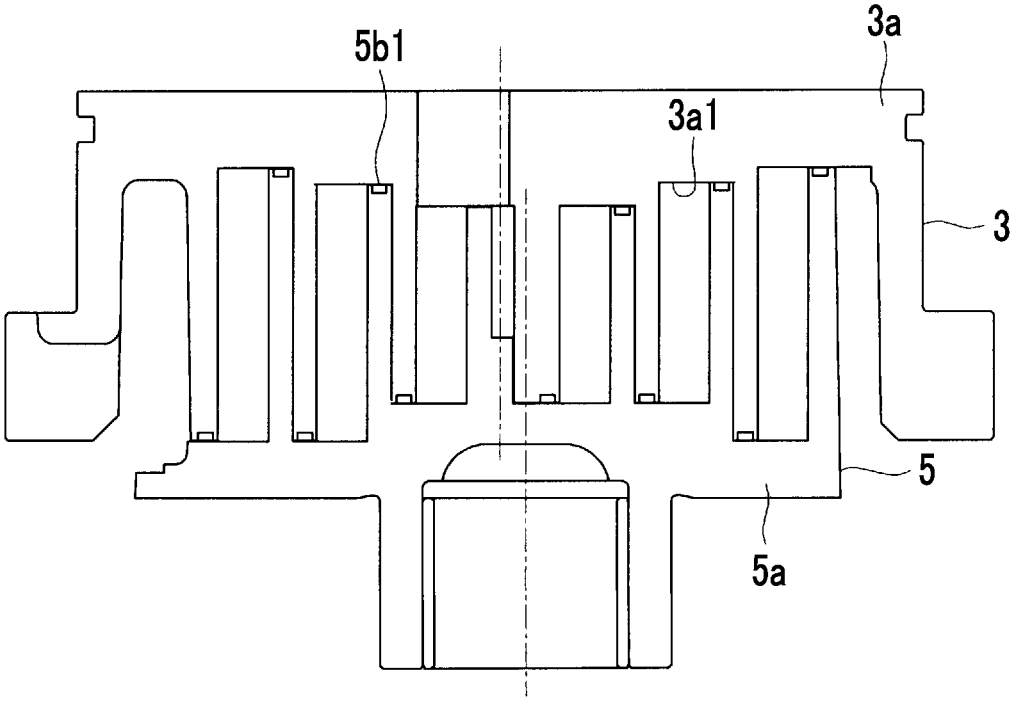

In addition, as shown in FIG. 10B, it may be combined with a stepped shape of the related art, that is, it may be combined with a shape in which a step portion is provided on the end plate 5*a* of the orbiting scroll 5 while the end plate inclined portion 3*a*1 is provided on the end plate 3*a* of the fixed scroll 3.

In the present embodiment, the wall flat portions 3*b*2, 3*b*3, 5*b*2, and 5*b*3 and the end plate flat portions 3*a*2, 3*a*3, 5*a*2, and 5*a*3 are provided. However, the flat portions on the inner peripheral side and/or the outer peripheral side may be omitted, and the inclined portion may be provided so as to extend to the entire walls 3*b* and 5*b*.

In the present embodiment, the scroll compressor is described. However, the present invention can be applied to a scroll expander which is used as an expander.

REFERENCE SIGNS LIST

1: scroll compressor (scroll fluid machine)
3: fixed scroll (first scroll member)

3*a*: end plate (first end plate)
3*a*1: end plate inclined portion
3*a*2: end plate flat portion (inner peripheral side)
3*a*3: end plate flat portion (outer peripheral side)
3*a*4: end plate inclined connection portion (inner peripheral side)
3*a*5: end plate inclined connection portion (outer peripheral side)
3*b*: wall (first wall)
3*b*1: wall inclined portion
3*b*2: wall flat portion (inner peripheral side)
3*b*3: wall flat portion (outer peripheral side)
3*b*4: wall inclined connection portion (inner peripheral side)
3*b*5: wall inclined connection portion (outer peripheral side)
3*c*: discharge port
3*d*: tip seal groove
5: orbiting scroll (second scroll member)
5*a*: end plate (second end plate)
5*a*1: end plate inclined portion
5*a*2: end plate flat portion (inner peripheral side)
5*a*3: end plate flat portion (outer peripheral side)
5*a*4: end plate inclined connection portion (inner peripheral side)
5*a*5: end plate inclined connection portion (outer peripheral side)
5*b*: wall (second wall)
5*b*1: wall inclined portion
5*b*2: wall flat portion (inner peripheral side)
5*b*3: wall flat portion (outer peripheral side)
5*b*4: wall inclined connection portion (inner peripheral side)
5*b*5: wall inclined connection portion (outer peripheral side)
7: tip seal
8: tooth tip corner
8*a*: chamfered portion
9: tooth bottom corner
9*a*: step portion
De: end mill distance
L: inter-facing surface distance
T: tip clearance
Tg: tooth bottom width
φ: inclination

The invention claimed is:

1. A scroll fluid machine comprising:

a first scroll member in which a spiral first wall is provided on a first end plate; and a second scroll member in which a spiral second wall is provided on a second end plate disposed to face the first end plate and the spiral second wall meshes with the spiral first wall such that the second scroll member performs a revolution orbiting movement relative to the first scroll member, wherein a first wall flat portion is provided each on an outermost peripheral portion and an innermost peripheral portion of the spiral first wall, the first wall flat portion having a height which is not changed, and a second end plate flat portion is provided on the second end plate so as to correspond to each of the first wall flat portion, wherein a first wall inclined portion is provided over a region between the first wall flat portion provided on the outermost peripheral portion and the first wall flat portion provided on the innermost peripheral portion, the spiral first wall inclined portion having a height which continuously decreases from an outer peripheral side toward an inner peripheral side thereof, wherein a second end plate inclined portion is provided over a region between the second end plate flat portion provided on the outermost peripheral portion and the second end plate flat portion provided on the innermost peripheral portion, the second end plate inclined portion having a tooth bottom surface which faces a tooth tip of the spiral first wall inclined portion and is inclined according to an inclination of the first wall inclined portion, and wherein in a tooth tip of the spiral first wall, a chamfered portion is provided at a tooth tip corner facing a tooth bottom corner of a base of a meshing wall the second wall meshing with the spiral first wall.

2. The scroll fluid machine according to claim 1, wherein the chamfered portion has a shape which avoids a contact with a step portion formed at the tooth bottom corner adjacent to the base of the second wall.

3. The scroll fluid machine according to claim 2, wherein the chamfered portion is provided at the tooth tip corner of the first wall corresponding to the second end plate inclined portion, and wherein the chamfered portion is not provided at the tooth tip corner of the first wall flat portion.

4. The scroll fluid machine according to claim 1, wherein the chamfered portion is provided at the tooth tip corner of the first wall corresponding to the second end plate inclined portion, and wherein the chamfered portion is not provided at the tooth tip corner of the first wall flat portion.

5. The scroll fluid machine according to claim 1, wherein a second wall flat portion is provided each on an outermost peripheral portion and an innermost peripheral portion of the second wall, the second wall flat portion having a height which is not changed, and a first end plate flat portion is provided on the first end plate so as to correspond to each of the second wall flat portion, wherein a second wall inclined portion is provided over a region between the second wall flat portion provided on the outermost peripheral portion and the second wall flat portion provided on the innermost peripheral portion, the second wall inclined portion having a height which continuously decreases from an outer peripheral side toward an inner peripheral side thereof, and wherein a first end plate inclined portion is provided over a region between the first end plate flat portion provided on the outermost peripheral portion and the first end plate flat portion provided on the innermost peripheral portion, the first end plate inclined portion having a tooth bottom surface which faces a tooth tip of the second wall inclined portion and is inclined according to an inclination of the second wall inclined portion.

6. A method for processing a scroll member including an end plate, a spiral wall provided on the end plate, wherein a wall flat portion is provided each on an outermost peripheral portion and an innermost peripheral portion of the spiral wall, the wall flat portion having a height which is not changed, and an end plate flat portion is provided on the end plate so as to correspond to each of the wall flat portion, wherein a wall inclined portion is provided over a region between the wall flat portion provided on the outermost peripheral portion and the wall flat portion provided on the innermost peripheral portion, the wall inclined portion having a height which continuously decreases from an outer peripheral side toward an inner peripheral side thereof, and wherein an end plate inclined portion is provided over a region between the end plate flat portion provided on the outermost peripheral portion and the end plate flat portion provided on the innermost peripheral portion, the end plate inclined portion having a tooth bottom surface which faces a tooth tip of the wall inclined portion and is inclined according to an inclination of the wall inclined portion, the method comprising:

a first peripheral wall surface processing step of processing one peripheral wall surface of the spiral wall and a tooth bottom adjacent the one peripheral wall surface;

a second peripheral wall surface processing step of processing the other peripheral wall surface of the spiral wall and a tooth bottom adjacent to the other peripheral wall surface; and a tooth bottom processing step of processing only a tooth bottom between the one peripheral wall surface and the other peripheral wall surface.

7. The method for processing a scroll member according to claim 6, further comprising: a chamfering processing step of forming a chamfered portion at a tooth tip corner of the spiral wall.

* * * * *